US006655283B2

(12) United States Patent
Deslangle et al.

(10) Patent No.: US 6,655,283 B2
(45) Date of Patent: Dec. 2, 2003

(54) METHOD AND DEVICE FOR FASTENING A PRINTING PLATE TO A PLATE CYLINDER OF A ROTARY PRINTING MACHINE

(75) Inventors: Dominique Deslangle, Orleans (FR); Christophe Noiret, Sait leu d Esserent (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/154,598

(22) Filed: May 23, 2002

(65) Prior Publication Data

US 2002/0174788 A1 Nov. 28, 2002

(30) Foreign Application Priority Data

May 23, 2001 (DE) ..... 101 25 133

(51) Int. Cl.[7] ..... B41F 27/12
(52) U.S. Cl. ..... 101/477; 101/415.1
(58) Field of Search ..... 101/477, 415.1, 101/486

(56) References Cited

U.S. PATENT DOCUMENTS 2,209,127 A * 7/1940 Lowe ..... 101/415.1
2,898,854 A * 8/1959 Crawford ..... 101/415.1
4,304,182 A 12/1981 Etchell et al.
5,224,423 A * 7/1993 Borel ..... 101/415.1
5,309,835 A * 5/1994 Hartung et al. ..... 101/415.1
5,560,298 A * 10/1996 Krokolinski et al. ..... 101/486
6,129,018 A 10/2000 Koppelkamm
6,199,280 B1 * 3/2001 Schneider et al. ..... 101/415.1
6,345,575 B1 2/2002 Metrope

FOREIGN PATENT DOCUMENTS

DE 19815935 A1 10/1999
DE 19934271 A1 5/2000
DE 19924785 A1 12/2000
EP 0654349 B2 5/1995

OTHER PUBLICATIONS

Published International Application No. 00/73066 A2 (Schneider et al.), dated Dec. 7, 2000.

* cited by examiner

*Primary Examiner*—Leslie J. Evanisko
(74) *Attorney, Agent, or Firm*—Laurence A. Greenberg; Werner H. Stemer; Ralph E. Locher

(57) ABSTRACT

A method and a device are provided for fastening a printing plate to a plate cylinder of a rotary printing machine. The printing plate has first and second ends to be accommodated in a clamping gap in a circumferential surface of the plate cylinder at least approximately parallel to an axis of rotation of the plate cylinder. The first end is inserted into the clamping gap. An edge of the printing plate is bent over in a region of the first end at an edge of the clamping gap. The printing plate is wound onto the circumferential surface until the second end comes to lie over the clamping gap. The second end is pressed into the clamping gap and deforms the printing plate so that the second end blocks the first end in the clamping gap.

23 Claims, 2 Drawing Sheets

METHOD AND DEVICE FOR FASTENING A PRINTING PLATE TO A PLATE CYLINDER OF A ROTARY PRINTING MACHINE

BACKGROUND OF THE INVENTION

Field of the Invention

The invention relates to a method for fastening a printing plate onto a plate cylinder of a rotary printing machine, in particular a web-fed rotary offset printing machine. The invention also relates to a device for fastening a printing plate to a plate cylinder of a rotary printing machine, in particular a web-fed rotary offset printing machine. In the heretofore known method and device of these general types, provision is made for the printing plate to have a first end and a second end, which are accomodated in a clamping gap formed in the circumferential surface of the plate cylinder, at least approximately parallel to the axis of rotation of the plate cylinder.

Before the printing plate can be fastened to the plate cylinder, both of the ends of the printing plate are initially bent over with the aid of an edge bending device located outside the printing machine. The bent-over first end is then inserted into the clamping gap and held firmly with the aid of a clamping device. The printing plate is then wound onto the circumferential surface of the plate cylinder until the bent-over second end is located over the clamping gap. Finally, this bent-over second end is likewise inserted into the clamping gap and held firmly with the aid of a second clamping device. Each clamping device includes at least one movable jaw which, in order to hold the bent-over end firmly, can be set against the latter and forces it against a side wall of the clamping gap. The clamping gap, therefore, has to be of sufficient width for accommodating the clamping devices. In addition, the clamping devices increase the construction expense and, therefore, the production and maintenance costs of the plate cylinder. In the case of rotary printing machines, however, it is desired that the clamping gap be as narrow as possible, because the part of the circumferential surface of the plate cylinder which is occupied by the clamping gap is not available for the printing. Primarily, for web-fed rotary printing machines wherein paper is infed in the form of a paper web unwound from a paper reel, the width of the clamping gap is a measure of the paper wastage.

A further disadvantage of the heretofore known method and device is that the edge-bending device has to be procured and operated separate from the actual printing machine. In addition, the printing plates provided with bent-over ends present problems when stored in a magazine for automatic printing-plate changing, because at least two printing plates have to be stored or handled simultaneously in such a magazine, so that damage may possibly occur quite easily to the sensitive printing surface of one printing plate by the bent-over ends of the other printing plate.

Furthermore, the bending over of the edges must be carried out very carefully, because the printing plates cannot be aligned correctly on the plate cylinder if the required angles and radii are not respected when the edges are bent over, and the edge-bending line does not extend perpendicularly to the longitudinal edges of the printing plate. Even a slight shape difference between printing plate and cylinder increases the risk that the printing plate will tear on the cylinder, as a result of which the entire printing machine can be damaged seriously.

The published European Patent Document EP 0 654 349 B2 discloses a sheet-fed rotary printing machine having an automatic plate changing device, wherein the printing plates are fed in flat form at least approximately tangentially to the plate changing device from a magazine and, with the aid of an edge turning or bending bar and a pressure roller, are provided with a bent-over edge on one side immediately before being inserted into the appertaining plate clamping device. In the described device, both the plate leading edge and the plate trailing edge are held in separate clamping devices, which can be operated separately and are spaced at a great circumferential distance from one another, the great spaced distance being usual for sheet-fed printing machines.

SUMMARY OF THE INVENTION

It is therefore an object of the invention to provide a method and a device of the type mentioned at the introduction hereto wherein the plate cylinder is constructed more simply, the clamping gap is narrower and a separate edge-turning or bending device is unnecessary.

With the foregoing and other objects in view, there is provided, in accordance with one aspect of the invention, a method for fastening a printing plate to a plate cylinder of a rotary printing machine, more particularly a web-fed rotary offset printing machine, the printing plate having a first end and a second end, both of which being accommodatable in a clamping gap formed in the circumferential surface of the plate cylinder at least approximately parallel to the axis of rotation of the plate cylinder, which comprises the following method steps: inserting the first end of the printing plate into the clamping gap; bending over an edge of the printing plate in the region of the first end at an edge of the clamping gap; winding the printing plate onto the circumferential surface of the plate cylinder until the second end of the printing plate comes to lie over the clamping gap; and pressing the second end of the printing plate into the clamping gap, and deforming the printing plate so that the second end blocks the first end of the printing plate in the clamping gap.

In accordance with another mode, the method includes, in order to bend over an edge, setting an edge-bending element against the plate cylinder in the region of the trailing edge of the clamping gap, as viewed in the continuous printing direction, and rotating the plate cylinder in the continuous printing direction relative to the edge-bending element.

In accordance with a further mode, the method includes providing a pressure roller as the edge-bending element.

In accordance with an added mode, the method further includes, in the winding step, setting a pressure element against the printing plate, and rotating the plate cylinder in the continuous printing direction relative to the pressure element.

In accordance with an additional mode, the method further includes providing a pressure roller as the pressure element.

In accordance with yet another mode, the method further includes providing the pressure roller as a single pressure roller serving as both the edge-bending element and a pressure element and, in the winding step, setting the pressure roller against the printing plate, and rotating the plate cylinder in the continuous printing direction relative to the pressure roller.

In accordance with yet a further mode, the method further includes setting a blade against the second end of the printing plate for inwardly pressing the printing plate, and pressing the second end of the printing plate into the clamping gap.

In accordance with yet an added mode, the method further includes providing for the trailing side wall of the clamping gap, as viewed in the continuous printing direction, to extend at an acute angle to the circumferential surface of the plate cylinder.

In accordance with yet an additional mode, the method further includes providing the clamping gap with a cross section having at least approximately the shape of a trapezoid, with the short base thereof forming the opening of the clamping gap.

In accordance with still another mode, the method further includes introducing compressed air into the clamping gap in order to loosen the printing plate from the plate cylinder.

In accordance with still a further mode, the method further includes assigning a blanket cylinder to the plate cylinder, the blanket cylinder bearing a rubber blanket sleeve which is pullable axially off the blanket cylinder.

In accordance with another aspect of the invention, there is provided a device for fastening a printing plate to a plate cylinder of a rotary printing machine, more particularly a web-fed rotary offset printing machine, the printing plate having a first end and a second end, both of which are accommodatable in a clamping gap formed in the circumferential surface of the plate cylinder, at least approximately parallel to the axis of rotation of the plate cylinder, comprising an edge-bending device serving for bending an edge of the printing plate in a region of a first end thereof on an edge of the clamping gap, after the first end has been inserted into the clamping gap; a winding device serving for winding the printing plate onto the circumferential surface of the plate cylinder, due to which a second end of the printing plate has come to lie over the clamping gap; and a pressing device serving for pressing the second end of the printing plate into the clamping gap, and for deforming the second end, so that the second end blocks the first end of the printing plate in the clamping gap.

In accordance with a further feature of the invention, the edge-bending device includes an edge-bending element and is formed so that during the edge bending, the edge-bending element is pressed against the plate cylinder in the region of the trailing edge of the clamping gap, as viewed in the continuous printing direction.

In accordance with an added feature of the invention, the edge-bending element is formed by a pressure roller.

In accordance with an additional feature of the invention, the winding device includes a pressure element and is formed so that the pressure element is set against the plate cylinder during the winding.

In accordance with yet another feature of the invention, the pressure element is formed by a pressure roller.

In accordance with yet a further feature of the invention, the pressure roller is a single pressure roller serving both as the edge-bending element and as a pressure element and, in the winding step, the pressure roller being set against the printing plate, and the plate cylinder being rotated in the continuous printing direction relative to the pressure roller.

In accordance with yet an added feature of the invention, the pressing device includes a blade and is formed so that during the inward pressing, the blade is set against the second end and presses the second end into the clamping gap.

In accordance with yet an additional feature of the invention, the trailing side wall of the clamping gap, as viewed in the continuous printing direction, extends at an acute angle to the circumferential surface of the plate cylinder.

In accordance with still another feature of the invention, the clamping gap has a cross section at least approximately having the form of a trapezoid, with the short base thereof forming the opening of the clamping gap.

In accordance with still a further feature of the invention, the fastening device further comprises a compressed-air line connected to the clamping gap, via which the clamping gap is actable upon by compressed air in order to loosen the printing plate from the plate cylinder.

In accordance with a concomitant feature of the invention, the fastening device further comprises a blanket cylinder assigned to the plate cylinder, the blanket cylinder bearing a rubber blanket sleeve pullable axially from the blanket cylinder.

Accordingly, the method according to the invention comprises the following method steps: inserting the first end of the printing plate into the clamping gap; bending or turning over the edge of the printing plate in the region of a first end thereof at an edge of the clamping gap; winding the printing plate onto the circumferential surface of the plate cylinder until a second end of the printing plate comes to lie over the clamping gap; and pressing the second end of the printing plate into the clamping gap, and deforming the printing plate, so that the second end blocks the first end of the printing plate in the clamping gap.

Furthermore, the fastening device according to the invention comprises the following features: an edge-bending device serving for bending over an edge of the printing plate in the region of the first end thereof on an edge of the clamping gap, after the first end has been inserted into the clamping gap; a winding device serving for winding the printing plate onto the circumferential surface of the plate cylinder, due to which the second end of the printing plate comes to lie over the clamping gap; and a pressing device serving for pressing the second end of the printing plate into the clamping gap, and deforming the second end, so that the second end blocks the first end of the printing plate in the clamping gap.

Because the printing plate, in the case of this method and this device, is initially inserted by the first end thereof into the clamping gap, and the edge at the first end is then bent or turned over at an edge of the clamping gap, a separate edge-bending or turning device, i.e., one that is separate from the printing machine, and the operations associated therewith are unnecessary; and it is possible for flat printing plates, i.e., those without bent-over ends, to be used, which can be handled and stored easily, in a space-saving and reliable or safe manner. Because, in addition, the action of bending over the edge of the printing plate is carried out at one edge of the clamping gap, i.e., in direct cooperation with the outer contour of the plate cylinder, a high accuracy of fit is achieved between printing plate and plate cylinder in the region of the bent-over end, and the printing plate is aligned exactly with the plate cylinder in the region of the first end thereof.

Because, furthermore, both ends are blocked in the clamping gap, after the second end of the printing plate has been introduced, clamping devices are no longer required. The method may provide that, for the purpose of bending over an edge, an edge-bending element is set against the plate cylinder in the region of the trailing edge of the clamping gap, as viewed in the continuous printing direction, and the plate cylinder is rotated in the continuous printing direction relative to the edge-bending element. The relative rotation between plate cylinder and edge-bending element can be effected by rotating the plate cylinder in the continuous printing direction and/or rotating the edge-bending element counter to the continuous printing direction.

In a corresponding manner, in the fastening device of the invention, provision may be made for the edge-bending device to include an edge-bending element and be formed so that, as the edges are being bent over, the edge-bending element presses against the plate cylinder in the region of the trailing edge of the clamping gap, as viewed in the continuous printing direction.

In the method and the device, provision may be made for the edge-turning element to be formed as a pressure roller.

In addition, for the purpose of winding, provision may be made in the method for a pressure element to be set against the printing plate and for the plate cylinder to be rotated in the continuous printing direction relative to the pressure element. The relative rotation between the plate cylinder and the pressure element may be effected by rotating the plate cylinder in the continuous printing direction and/or rotating the pressure element counter to the continuous printing direction.

In a corresponding manner, provision may be made in the fastening device of the invention for the winding device to comprise a pressure element and to be formed in a manner that, during the winding operation, the pressure element is set against the plate cylinder.

In the method and the device, provision may be made for the pressure element to be formed as a pressure roller.

Furthermore, in the method and the device, provision may be made for both the edge-bending element and the pressure element to be formed by a single pressure roller. In this way, the expenditure for construction is further reduced.

Furthermore, for the purpose of inward pressing, provision may be made in the method for a blade to be set against the second end of the printing plate and to press the latter into the clamping gap. If the blade is pressed further into the clamping gap, after it has been set against the second end of the printing plate, the second end will yield to this action by being deformed and wrapped with an at least approximately U-shaped cross section around the cutting edge of the blade, so that the edge contacts the bent-over first end which is already located in the clamping gap. The blade is withdrawn from the clamping gap when the edge of the second end, now bent in a U-shape, is supported on the bent-over first end. As a result, both ends of the printing plate are blocked in the clamping gap.

In a corresponding manner, provision can be made in the fastening device according to the invention for the pressing device to comprise a blade and to be formed in a way that, during the inward pressing, the blade is set against the second end and presses the latter into the clamping gap.

Furthermore, provision can be made in the method and the fastening device for the trailing side wall of the clamping gap, as viewed in the continuous printing direction, to extend at an acute angle to the circumferential surface of the plate cylinder. The front side wall, therefore, springs back under the circumferential surface in the manner of an undercut. If, then, the second end of the printing plate is deformed as it is pressed into the clamping gap, and is supported on the leading side wall and the opposite trailing side wall of the clamping gap, as viewed in the continuous printing direction, the leading side wall better absorbs the radially outwardly directed centrifugal forces, which are produced during the rotation of the plate cylinder during the printing operation and attempt to drive both ends of the printing plate out of the clamping gap, than if it were to extend perpendicularly to the circumferential surface of the plate cylinder, i.e., radially.

Furthermore, provision may be made for the method and the fastening device according to the invention for the cross section of the clamping gap to have the shape at least approximately of a trapezoid, the short base of which forms the opening of the clamping gap.

Also, provision may be made in the method for compressed air to be fed into the clamping gap in order to loosen the printing plate from the plate cylinder. The compressed air forces the deformed second end of the printing plate out of the clamping gap, so that the printing plate can be unwound from the plate cylinder and the bent-over first end of the plate can be removed from the clamping gap.

In a corresponding manner, provision may be made in the fastening device according to the invention for a compressed-air line to be connected to the clamping gap, via which the clamping gap is actable upon by compressed air in order to loosen the printing plate from the plate cylinder.

In addition, provision may be made in the method and the fastening device for the plate cylinder to have a blanket cylinder assigned thereto, the blanket cylinder bearing a rubber blanket sleeve which is pullable axially off the blanket cylinder. Particularly good printing results can be achieved with such a rubber blanket sleeve, because it is endless, as viewed in the circumferential direction, i.e., it has no gap and rests on the blanket cylinder uniformly even at high rotation speeds. In addition, the down times of the printing machine, which are caused by a damaged rubber blanket or a web break, during which the paper web winds around the blanket cylinder, are reduced considerably, because the affected rubber blanket sleeve with the section web wound around it can simply be removed axially from the blanket cylinder through an opening formed in the side wall of the printing machine and can then be replaced by a new rubber blanket sleeve. The result is that the removal of the compressed and hardened layer of paper web and ink from the blanket cylinder, which is required when conventional finite-length rubber blankets are used and is very time-consuming, is thus dispensed with.

Other features which are considered as characteristic for the invention are set forth in the appended claims.

Although the invention is illustrated and described herein as embodied in a method and device for fastening a printing plate to a plate cylinder of a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
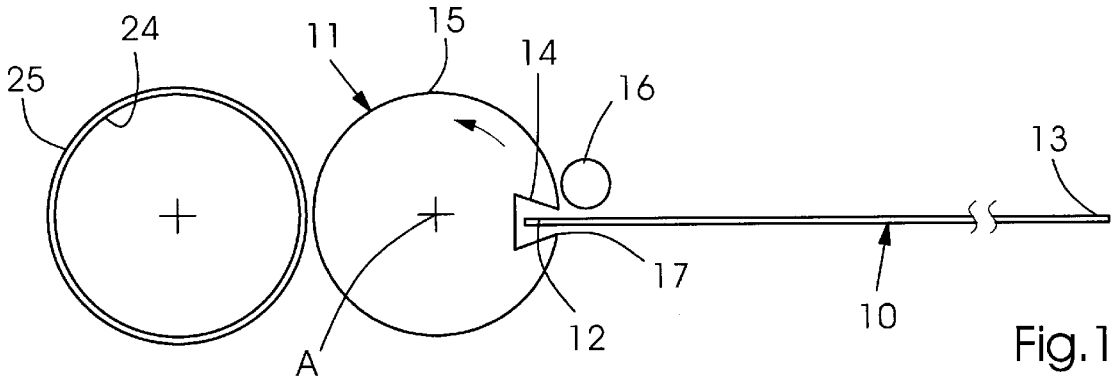
FIG. 1 is a diagrammatic side elevational view of a preferred embodiment of a device for fastening a printing plate to a plate cylinder of a rotary printing machine in a first operating phase wherein a first step of the method for fastening the printing plate according to the invention takes place.

Referring now to FIGS. 1 to 4 of the drawings, there is shown, respectively, therein a device for fastening a printing plate 10 to a plate cylinder 11 of a rotary printing machine in various method steps during the fastening of the printing plate 10. The printing plate 10 has a first end 12 and a second end 13. The plate cylinder 11 has a clamping gap 14, which is formed in the circumferential surface 15 of the plate cylinder 11 and extends parallel to an axis of rotation A of the plate cylinder 11. The device has an edge-turning or bending device, a winding device and a pressing device, which are described more extensively further hereinbelow. Assigned to the plate cylinder 11 is a blanket cylinder 24 having a rubber blanket sleeve 25 which, during the printing operation, picks up the printing image from the printing plate 10 and applies it to a non-illustrated paper web.

Figure 4:
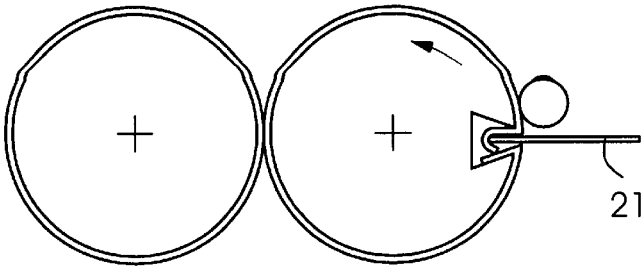
FIG. 4 is a view like those of FIGS. 1 to 3 showing the device in a fourth operating phase wherein a fourth step of the method is performed.
Figure 5:
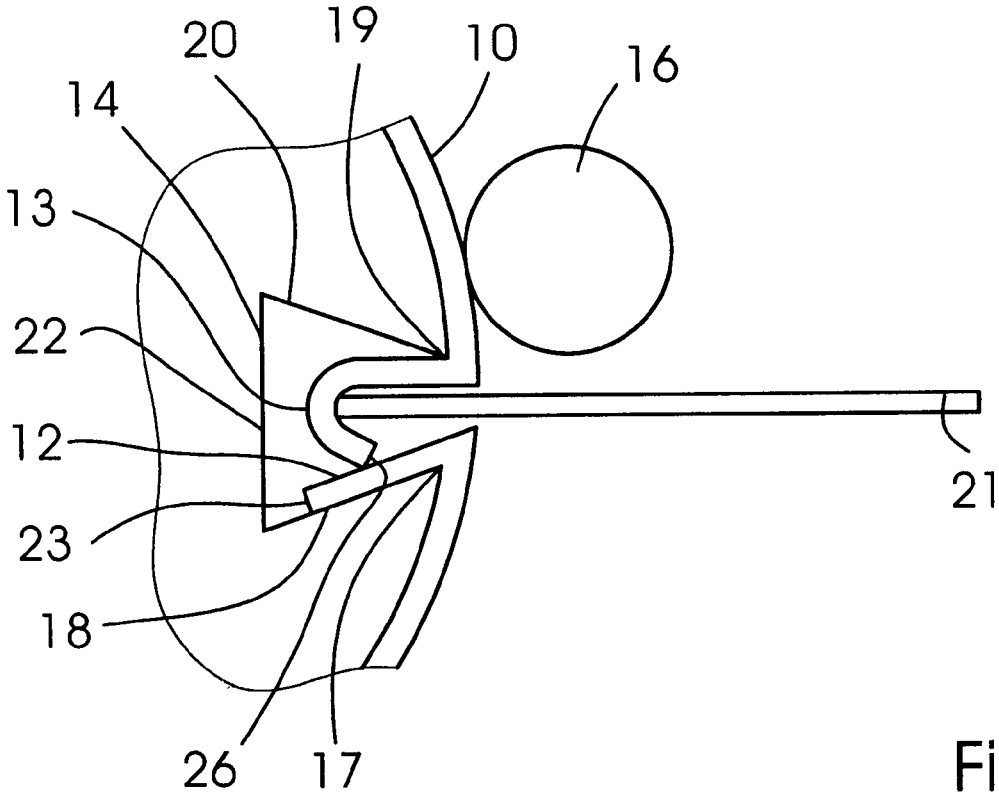
FIG. 5 is an enlarged fragmentary view of FIG. 4 showing the region of the clamping gap.

A clamping gap 14 is shown enlarged in FIG. 5. As viewed in the continuous printing direction (represented in FIGS. 1 to 4 by the curved arrow directed in counterclockwise rotational direction of the plate cylinder 11), the clamping gap 14 is defined by a trailing edge 17, a subsequent trailing side wall 18, a leading edge 19, as viewed in the continuous printing direction, and a subsequent leading side wall 20. The clamping gap 14 has a cross section in the form of an equilateral trapezoid, the short base of which forms the opening, and the long base of which forms the bottom 22 of the clamping gap 14. The clamping gap 14 is therefore always wider towards the axis of rotation A of the plate cylinder 11, so that the trailing side wall 18 and the leading side wall 20, respectively, extend at an acute angle to the circumferential surface 15 of the plate cylinder 11. An edge-turning or bending device serves for bending over the edge of the printing plate 10 in the region of the first end 12 thereof, after the first end 12 has been inserted into the clamping gap 14. The edge-turning or bending device has an edge-turning element, which is formed here by a pressure roller 16, and also by a non-illustrated device for pressing the pressure roller 16 against the plate cylinder 11 in the region of the trailing edge 17 of the clamping gap 14, as the trailing edge 17 is being turned or bent over. Furthermore, a non-illustrated holding device, for example, in the form of an eccentric shaft heretofore known from plate clamping devices, can be arranged in the clamping gap 14 for holding the first plate end 12 against the trailing side wall 18 as the edge is being turned or bent over.

The aforementioned non-illustrated winding device serves for winding the printing plate 10 onto the circumferential surface 15 of the plate cylinder 11 until the second end 13 of the printing plate 10 comes to lie over the clamping gap 14. The winding device includes a pressure element, which is likewise formed here by the pressure roller 16, and also by a non-illustrated device serving for setting the pressure roller 16 against the plate cylinder 11 during the winding operation.

Although in this embodiment, the pressure roller 16 forms both the edge-turning or bending element of the edge-turning device and the pressure element of the winding device, two pressure rollers (not illustrated) can also be provided, one of which forms the edge-turning or bending element, and the other the pressure element.

The non-illustrated pressing device serves for pressing the second end 13 of the printing plate 10 into the clamping gap 14, deforming the printing plate 10 in a manner that the second end 13 blocks the first end 12 of the printing plate 10 in the gap 14. The pressing device has a blade 21 and a non-illustrated device serving for setting the blade 21 against the second end 13 of the printing plate 10, and for pressing the second end 13 into the clamping gap 14.

FIG. 1 represents the first method step of a preferred mode of the method for fastening the printing plate 10 to the plate cylinder 11, and relates to the insertion of the first end 12 of the printing plate 10 into the clamping gap 14. In order to be able to align the printing plate 10 exactly axially with respect to the plate cylinder 11, the edge 23 of the first end 12 of the printing plate 11, which is inserted into the clamping gap 14 first, is formed with a plurality of non-illustrated cutouts, and the bottom 22 of the clamping gap 14 is formed with matching elevations, for example, non-illustrated register pins, so that the first end 12 can only be inserted entirely into the clamping gap 14 when the elevations on the bottom 22 are seated in the respectively assigned cutouts formed in the edge 23. As is apparent from FIG. 1, the flat printing plate 10 is inserted into the clamping gap 14 at least approximately in radial direction. In this regard, the pressure roller 16 is located just in front of the leading edge 19 of the clamping gap 14, as viewed in the continuous printing direction.

Figure 2:
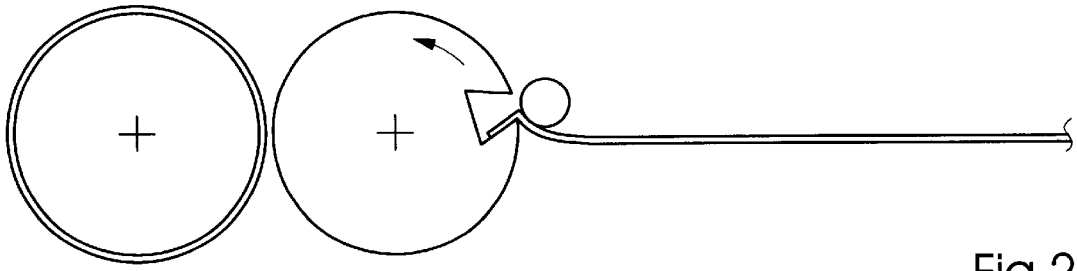
FIG. 2 is a view like that of FIG. 1 showing the device in a second operating phase wherein a second step of the method according to the invention is performed.

FIG. 2 represents the second method step, which relates to turning or bending over the edge of the printing plate 10 at the trailing edge 17 of the clamping gap 14. This method step, for one, includes setting the pressure roller 16 against the plate cylinder 11 in the region of the trailing edge 17, and therefore against the printing plate 10 in the region of the first end 12 of the latter, and for another, rotating the plate cylinder 11 then in the continuous printing direction. In order to effect this setting of the pressure roller 16, the plate cylinder 11 is rotated in the continuous printing direction from the position illustrated in FIG. 1 until the pressure roller 16 rests on the upper side of the printing plate 10 in the region of the first end 12 thereof. Because the plate cylinder 11 is rotated further in the continuous printing direction, and the pressure roller 16 remains pressed against the plate cylinder 11, the printing plate 10 gives way rearwardly, as viewed in the continuous printing direction, so that the edge thereof is turned or bent over at the trailing edge 17 of the clamping gap 14, and is pressed by the pressure roller 16 onto the circumferential surface 15 of the plate cylinder 11.

Figure 3:
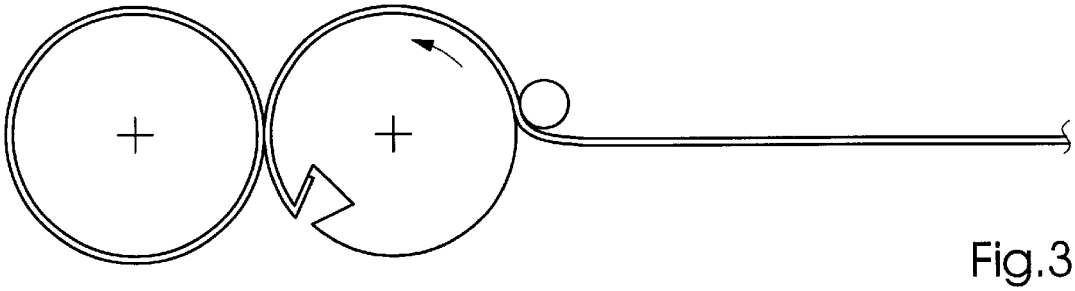
FIG. 3 is a view like those of FIGS. 1 and 2 showing the device in a third operating phase wherein a third step of the method is performed.

FIG. 3 illustrates the third method step, which relates to winding the printing plate 10 onto the circumferential surface 15 of the plate cylinder 11. This winding operation is effected by continually pressing the pressure roller 16 against the plate cylinder 11, and continuing to rotate the latter in the continuous printing direction. This method step ends when the plate cylinder 11 has completed one revolution, so that the second end 13 of the printing plate 10 comes to lie over the clamping gap 14. The length of the printing plate 10 is chosen so that the second end 13 thereof covers the opening of the clamping gap 14, and the edge 26 of the second end 13, as viewed in the continuous printing direction, preferably lies downstream of the trailing edge 17 of the clamping gap 14.

FIG. 4 illustrates the fourth method step, which relates to pressing the second end 13 of the printing plate 10 into the clamping gap 14. This inward pressing is effected by the blade 21 being set onto the upper side of the second end 13 of the printing plate 10, directly over the opening of the clamping gap 14, and then being pressed further radially into the clamping gap 14. In this regard, the blade 21 entrains the second end 13 and displaces the latter, while deforming it, into the clamping gap 14. In the process, the edge of the second end 13 is turned over on the leading edge 19 of the clamping gap 14 and preferably bent over into a U shape, so that the edge 26 rests on that part of the first end 12 which is already located in the clamping gap 14, as can be seen quite readily in FIG. 5. If the blade 21 has been pressed sufficiently far into the clamping gap 14, the second end 13 of the printing plate 10, which has been pressed into the clamping gap 14 by the blade 21, is deformed plastically so that the edge 26 thereof is supported on the first end 12, which is resting on the trailing side wall 18 of the clamping gap 14, so that the second end 13 blocks the first end 12 in the clamping gap 14. The blade 21 is then withdrawn from the clamping gap 14. The printing plate 10 is therefore fastened to the plate cylinder 11, and the actual printing operation can be started.

When the printing plate 10 is to be released from the plate cylinder 11, this can preferably be performed by feeding compressed air into the clamping gap 14 via a non-illustrated compressed-air line which opens into the clamping gap 14 underneath the second end 13 of the printing plate 10, as a result of which the second end 13 is forced radially out of the clamping gap 14 and, accordingly, the two ends 12 and 13 of the printing plate 10 are unblocked.

We claim:

1. A method for fastening a printing plate to a plate cylinder of a rotary printing machine, which comprises:

providing a plate cylinder having an axis of rotation and a circumferential surface with a clamping gap formed therein at least approximately parallel to the axis of rotation;

providing a printing plate having first and second ends to be accommodated in the clamping gap;

inserting the first end of the printing plate into the clamping gap;

bending over an edge of the printing plate in a region of the first end at an edge of the clamping gap;

winding the printing plate onto the circumferential surface of the plate cylinder until the second end of the printing plate comes to lie over the clamping gap; and pressing the second end of the printing plate into the clamping gap, and deforming the printing plate for blocking the first end of the printing plate in the clamping gap with the second end.

2. The method according to claim 1, which further comprises, in order to bend over an edge, setting an edge-bending element against the plate cylinder in a region of a trailing edge of the clamping gap, as viewed in a continuous printing direction, and rotating the plate cylinder in the continuous printing direction relative to the edge-bending element.

3. The method according to claim 2, which further comprises providing a pressure roller as the edge-bending element.

4. The method according to claim 3, which further comprises providing the pressure roller as a single pressure roller serving as both the edge-bending element and a pressure element and, in the winding step, setting the pressure roller against the printing plate, and rotating the plate cylinder in the continuous printing direction relative to the pressure roller.

5. The method according to claim 1, which further comprises, in the winding step, setting a pressure element against the printing plate, and rotating the plate cylinder in the continuous printing direction relative to the pressure element.

6. The method according to claim 5, which further comprises providing a pressure roller as the pressure element.

7. The method according to claim 1, which further comprises setting a blade against the second end of the printing plate for inwardly pressing the printing plate, and pressing the second end of the printing plate into the clamping gap.

8. The method according to claim 1, which further comprises orienting a trailing side wall of the clamping gap, as viewed in the continuous printing direction, at an acute angle to the circumferential surface of the plate cylinder.

9. The method according to claim 1, which further comprises providing the clamping gap with a cross section having at least approximately the shape of a trapezoid, with a short base thereof forming am opening of the clamping gap.

10. The method according to claim 1, which further comprises introducing compressed air into the clamping gap in order to loosen the printing plate from the plate cylinder.

11. The method according to claim 1, which further comprises assigning a blanket cylinder to the plate cylinder, the blanket cylinder bearing a rubber blanket sleeve to be pulled axially off the blanket cylinder.

12. In a rotary printing machine including a plate cylinder having an axis of rotation and a circumferential surface with a clamping gap formed therein at least approximately parallel to the axis of rotation, and a printing plate having first and second ends to be accommodated in the clamping gap, a device for fastening the printing plate to the plate cylinder, the device comprising:

an edge-bending device for bending an edge of the printing plate in a region of the first end thereof on an edge of the clamping gap, after inserting the first end into the clamping gap;

a winding device for winding the printing plate onto the circumferential surface of the plate cylinder, causing the second end of the printing plate to lie over the clamping gap; and a pressing device for pressing the second end of the printing plate into the clamping gap, and for deforming the second end to block the first end of the printing plate in the clamping gap with the second end.

13. The fastening device according to claim 12, wherein said edge-bending device includes an edge-bending element, and said edge-bending element is pressed during the edge bending against the plate cylinder in a region of a trailing edge of the clamping gap, as viewed in a continuous printing direction.

14. The fastening device according to claim 13, wherein said edge-bending element is a pressure roller.

15. The fastening device according to claim 14, wherein said pressure roller is a single pressure roller serving both as said edge-bending element and as a pressure element and, during winding, said pressure roller is set against the printing plate, and the plate cylinder is rotated in the continuous printing direction relative to said pressure roller.

16. The fastening device according to claim 12, wherein said winding device includes a pressure element, and said pressure element is set against the plate cylinder during the winding.

17. The fastening device according to claim 16, wherein said pressure element is a pressure roller.

18. The fastening device according to claim 12, wherein said pressing device includes a blade, and said blade is set against the second end and presses the second end into the clamping gap during inward pressing.

19. The fastening device according to claim 12, wherein the clamping gap has a trailing side wall extending at an acute angle to the circumferential surface of the plate cylinder, as viewed in a continuous printing direction.

20. The fastening device according to claim 12, wherein the clamping gap has a cross section at least approximately having the form of a trapezoid, with a short base thereof forming an opening of the clamping gap.

21. The fastening device according to claim 12, further comprising a compressed-air line connected to the clamping gap, for acting upon the clamping gap with compressed air to loosen the printing plate from the plate cylinder.

22. The fastening device according to claim 12, further comprising a blanket cylinder assigned to the plate cylinder, said blanket cylinder bearing a rubber blanket sleeve to be pulled axially from said blanket cylinder.

23. In a web-fed rotary offset printing machine including a plate cylinder having an axis of rotation and a circumferential surface with a clamping gap formed therein at least approximately parallel to the axis of rotation, and a printing plate having first and second ends to be accommodated in the clamping gap, a device for fastening the printing plate to the plate cylinder, the device comprising:

an edge-bending device for bending an edge of the printing plate in a region of the first end thereof on an edge of the clamping gap, after inserting the first end into the clamping gap;

a winding device for winding the printing plate onto the circumferential surface of the plate cylinder, causing the second end of the printing plate to lie over the clamping gap; and a pressing device for pressing the second end of the printing plate into the clamping gap, and for deforming the second end to block the first end of the printing plate in the clamping gap with the second end.

* * * * *